US010619831B2

(12) United States Patent
Kay et al.

(10) Patent No.: US 10,619,831 B2
(45) Date of Patent: Apr. 14, 2020

(54) LIGHT CLIP

(71) Applicant: SENTRY ELECTRIC LLC, Freeport, NY (US)

(72) Inventors: Shepard Kay, Merrick, NY (US); Leonid Aronov, Brooklyn, NY (US)

(73) Assignee: SENTRY ELECTRIC LLC, Freeport, NY (US)

( * ) Notice: Subject to any disclaimer, the term of this patent is extended or adjusted under 35 U.S.C. 154(b) by 450 days.

(21) Appl. No.: 15/657,435

(22) Filed: Jul. 24, 2017

(65) Prior Publication Data

US 2019/0024878 A1 Jan. 24, 2019

(51) Int. Cl.

| | |
|---|---|
| ***F21V 21/16*** | (2006.01) |
| ***F21V 21/08*** | (2006.01) |
| ***F21V 21/088*** | (2006.01) |
| ***F21V 19/00*** | (2006.01) |
| *F21Y 115/10* | (2016.01) |

(52) U.S. Cl.

CPC ..... *F21V 21/088* (2013.01); *F21V 19/001* (2013.01); *F21V 21/0816* (2013.01); *F21V 21/16* (2013.01); *F21V 19/0005* (2013.01); *F21Y 2115/10* (2016.08)

(58) Field of Classification Search

CPC ..... F21V 23/06; F21V 21/116; F21V 21/10; F21V 21/08

USPC ..... 362/431, 640

See application file for complete search history.

(56) References Cited

U.S. PATENT DOCUMENTS

| | | | | |
|---|---|---|---|---|
| 5,434,759 | A * | 7/1995 | Endo | G09F 13/22 362/103 |
| 5,727,865 | A * | 3/1998 | Caldwell | B60Q 1/305 362/368 |
| 6,062,700 | A * | 5/2000 | Price | A45F 5/00 362/103 |
| 8,651,714 | B1 * | 2/2014 | Hamasaki | B62J 6/02 362/473 |
| 2003/0223247 | A1 * | 12/2003 | Karras | B60Q 7/00 362/555 |
| 2005/0057921 | A1 * | 3/2005 | Menosky | B62J 6/02 362/110 |

* cited by examiner

*Primary Examiner* — William J Carter
(74) *Attorney, Agent, or Firm* — Moritt Hock & Hamroff LLP; Bret P. Shapiro

(57) ABSTRACT

Technologies are described for devices to secure a light fixture including a light source and electronics to a structure. The devices may comprise a curved first end. First walls of the first end may define a first opening. The devices may comprise first tabs that project from second walls of the first end. The first tabs and the second walls may define first and second protrusion openings. The second walls and first tabs may secure protrusions of the light fixture within the first and second protrusion openings. The devices may comprise a second end that includes end tabs attached to the second walls and angled ends extending from the end tabs. The end tabs and the angled ends may define a second opening. The second opening of the device may expand further open when the angled ends are pressed against the structure to secure to the device to the structure.

13 Claims, 4 Drawing Sheets

LIGHT CLIP

BACKGROUND

This application relates to devices and methods effective to secure a light fixture to a structure.

Structures such as building, towers, monuments, stadiums, and bridges may be lit for illumination, visibility, safety, and aesthetics. Light fixtures may include light-emitting diodes (LEDs), and may be attached to such structures. LEDs may emit light in narrow bands of electromagnetic wavelengths from a light fixture, and may provide a desired light intensity or color.

SUMMARY

In some examples devices to secure a light fixture to a structure are described. The light fixture may include a light source and electronics to drive the light source. The devices may comprise a first end of the device. The first end of the device may be curved and may include first walls and second walls. The first walls may define a first opening configured to accept a face of the light fixture so that light from the light fixture radiates out from the device when the light fixture is within the device. The devices may comprise first tabs. The first tabs may project from the second walls. The first tabs and the second walls may define a first protrusion opening on a first side of the device. The first tabs and the second walls may define a second protrusion opening on a second side of the device. The second walls and first tabs may be configured to accept and secure the light fixture when protrusions of the light fixture are placed within the first and second protrusion openings. The devices may comprise a second end of the device. The second end of the device may include end tabs and angled ends. The end tabs may be attached to the second walls. The angled ends may extend from the end tabs. The end tabs and the angled ends may be effective to define a second opening. The angled ends may be configured such that the second opening of the device expands further open when the angled ends are pressed against the structure to allow the device to be at least partially positioned around and secured to the structure.

In some examples, methods to secure a light fixture to a structure are described. The light fixture may include a light source and electronics to drive the light source. The methods may comprise securing the light fixture within a first side of a device. The methods may comprise pressing a second side of the device against the structure. The second side of the device may include tabs effective to define an open end and the open end may expand further open. The methods may comprise placing the device at least partially around the structure. A resiliency of the device may provide a pressing force to the structure. The methods may comprise securing a tie wrap around the device and the structure.

In some examples, systems to secure a light fixture to a structure are described. The systems may comprise a light fixture. The light fixture may include a face, protrusions, a light source, and electronics to drive the light source. The systems may comprise a tie wrap. The systems may comprise a device. The device may include a curved end of the device. The curved end may include first walls, second walls, first tabs, second tabs, and third tabs. The first walls may define a first opening. The first opening may be configured to accept the face of the light fixture. The first tabs may project from the second walls. The first tabs and the second walls may define a first protrusion opening on a first side of the device. The first tabs and the second walls may define a second protrusion opening on a second side of the device. The second walls and first tabs may be configured to accept and secure the light fixture when the protrusions of the light fixture are placed within the first and second protrusion openings. The second tabs may project from the second walls. The second tabs and the second walls may define first channels. The first channels may be configured to accept and secure a wire or coaxial cable. The third tabs may project from the second walls. The third tabs may be configured to prevent the tie wrap from sliding off of the device. The device may include a second end of the device. The second end of the device may include end tabs and angled ends. The end tabs and angle ends may be effective to define a second opening. The angled ends may be configured such that the second opening of the device expands further open when the angled ends are pressed against the structure to allow the device to be at least partially positioned around and secured to the structure.

The foregoing summary is illustrative only and is not intended to be in any way limiting. In addition to the illustrative aspects, embodiments, and features described above, further aspects, embodiments, and features will become apparent by reference to the drawings and the following detailed description.

BRIEF DESCRIPTION OF THE FIGURES

The foregoing and other features of this disclosure will become more fully apparent from the following description and appended claims, taken in conjunction with the accompanying drawings. Understanding that these drawings depict only several embodiments in accordance with the disclosure and are, therefore, not to be considered limiting of its scope, the disclosure will be described with additional specificity and detail through use of the accompanying drawings, in which:

Figure 1:
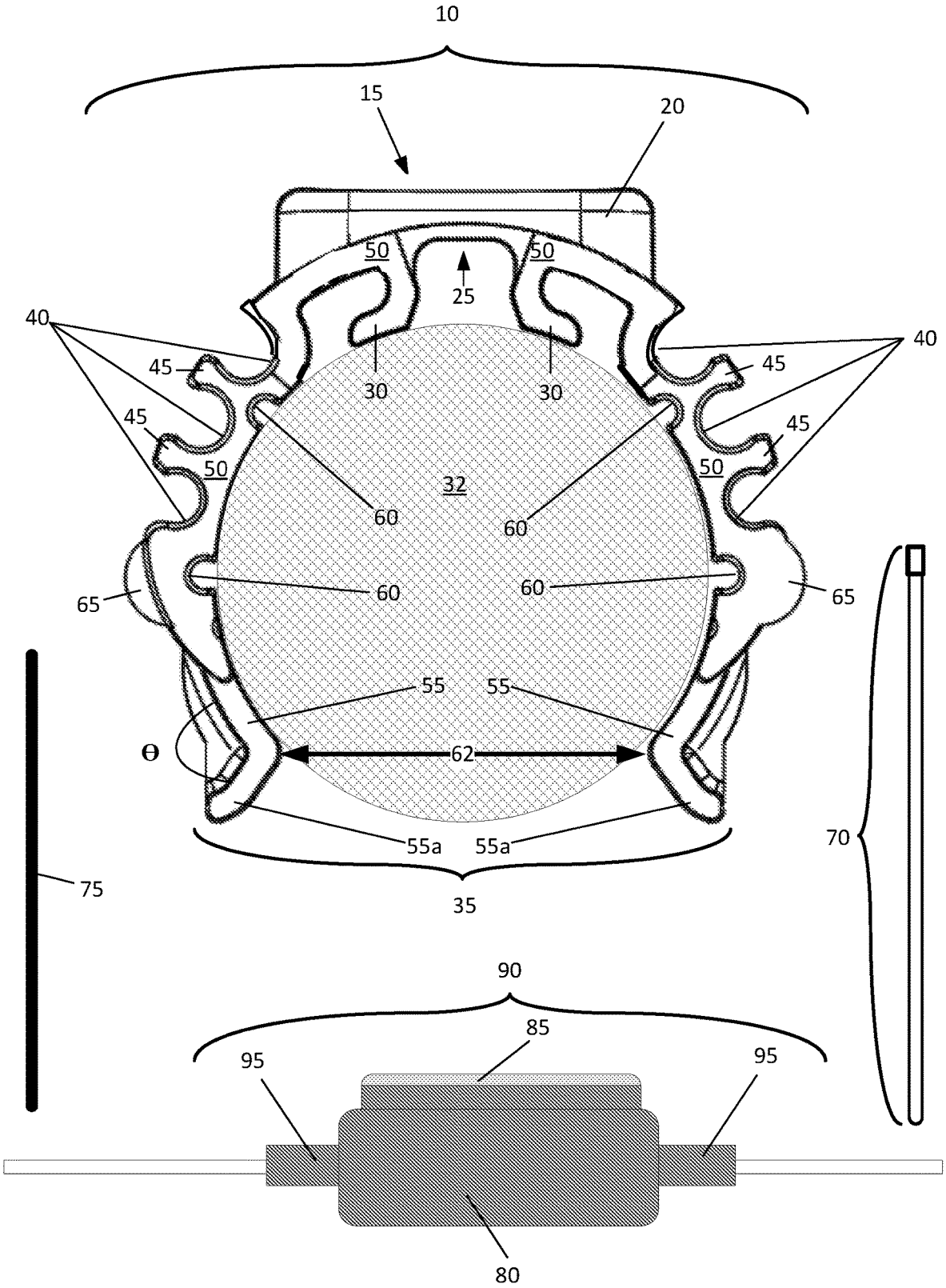
FIG. 1 is a side view of a light clip and a side view of a light fixture.

all arranged according to at least some embodiments described herein.

DETAILED DESCRIPTION

In the following detailed description, reference is made to the accompanying drawings, which form a part hereof. In the drawings, similar symbols typically identify similar components, unless context dictates otherwise. The illustrative embodiments described in the detailed description, drawings, and claims are not meant to be limiting. Other embodiments may be utilized, and other changes may be made, without departing from the spirit or scope of the subject matter presented herein. It will be readily understood that the aspects of the present disclosure, as generally described herein, and illustrated in the Figures, can be arranged, substituted, combined, separated, and designed in a wide variety of different configurations, all of which are explicitly contemplated herein.

It will be understood that any compound, material or substance which is expressly or implicitly disclosed in the specification and/or recited in a claim as belonging to a group or structurally, compositionally and/or functionally related compounds, materials or substances, includes individual representatives of the group and all combinations thereof FIG. 1 is a side view of a light clip 10 and a side view of a light fixture 90 arranged in accordance with at least some embodiments presented herein. As discussed in more detail below, light clip 10 may secure a light fixture to a structure.

Light clip 10 may include a device with a C-shape when viewed from a side and may include a curved end 15 and an open end 35. Light clip 10 may at least partially wrap around a structure 32, such as a support beam, a support cable, a pole or a protrusion of an edifice. Open end 25 of light clip 10 may be pressed against structure 32 and expand so that light clip 10 may at least partially encircle and be secured to structure 32. Light clip 10 may include one or more of a plastic material, a metal, and/or a composite material. Light clip 10 may include one or more of polyamide (PA), ethylene vinyl acetate (EVA), low-density polyethylene (LDPE), high-density polyethylene (HDPE), polypropylene (PP), polyvinyl chloride (PVC), thermoplastic elastomer (TPE), polyethylene terephthalate (PET), styrene acrylonitrile (SAN), acrylonitrile butadiene styrene (ABS), polycarbonate PC, copolymer, cellulosic, and/or cellulose acetate, with or without glass reinforcement.

Light fixture 90 may include a body 80, a face 85, and protrusion 95. Protrusions 95 may extend outward from body 80 on a first and second side of light fixture 90. Light fixture 90 may include a light source and may emit light from face 85. Body 80 of light fixture 90 may include electronics effective to drive the light source. Light fixture 90 may include one or more light emitting diodes (LEDs).

Curved end 15 of light clip 10 may include walls 20, walls 50, tabs 30, and tabs 45. Tabs 30 may project from walls 50. Tabs 30 and walls 50 may define a protrusion opening 25 on a first side of light clip 10 and a protrusion opening 25 on a second side of light clip 10. Tabs 30 and walls 50 may be configured to accept a light fixture 90. Tabs 30 may be effective to flex when protrusions 95 of light fixture 90 are placed within openings 25. Tabs 30 may be resilient and may provide a pressing force to protrusions 95 when protrusions 95 are placed within openings 25. The pressing force provided by tabs 30 may secure protrusions 95 in openings 25 when protrusions 95 are placed within openings 25.

Tabs 45 may project from walls 50. Tabs 45 and walls 50 of light clip 10 may define channels 40. Each channel 40 may be sized and shaped to accept and secure a wire or coaxial cable when an individual wire or coaxial cable is placed within a respective channel 40. Tabs 45 and walls 50 of light clip 10 may define multiple channels 40 and each channel 40 may accept and secure an individual wire or coaxial cable.

Walls 50 may further define channels 60. Channels 60 may be configured to accept and secure a filament 75 of material. Filament 75 may be a material with friction properties different from, and greater than, light clip 10. Filament 75 secured in channels 60 may increase a friction factor between light clip 10 and structure 32 when light clip 10 is secured to structure 32. Filament 75 secured in channels 60 may prevent light clip 10 from moving angularly around structure 32 when light clip 10 is secured to structure 32.

Light clip 10 may include tabs 65. Tabs 65 may protrude from side edges of walls 50. As discussed in more detail below, tabs 65 may be configured to accept and secure a tie wrap 70 to light clip 10.

Open end 35 of light clip 10 may include end tabs 55 and angle ends 55*a*. End tabs 55 may be attached to walls 50. Each angled end 55*a* may extend from each end tab 55 at an angle θ from plane of end tab 55. Angle θ may be from 45 to 135 degrees. End tabs 55 and angled ends 55*a* may define open end 35 and an opening 62. Angled ends 55*a* and end tabs 55 may be configured such that open end 35 and opening 62 of light clip 10 may expand further open when angled ends 55*a* are pressed against structure 32. Light clip 10 may be place at least partially around structure 32 when open end 35 and opening 62 is further opened. Light clip 10 may be resilient and end tabs 55 and walls 50 may provide a pressing force to structure 32 when light clip 10 is at least partially wrapped around structure 32. The pressing force provided by walls 50 and end tabs 55 may secure structure 32 within light clip 10 and may allow light clip 10 to be positioned around structure 32.

Figure 2:
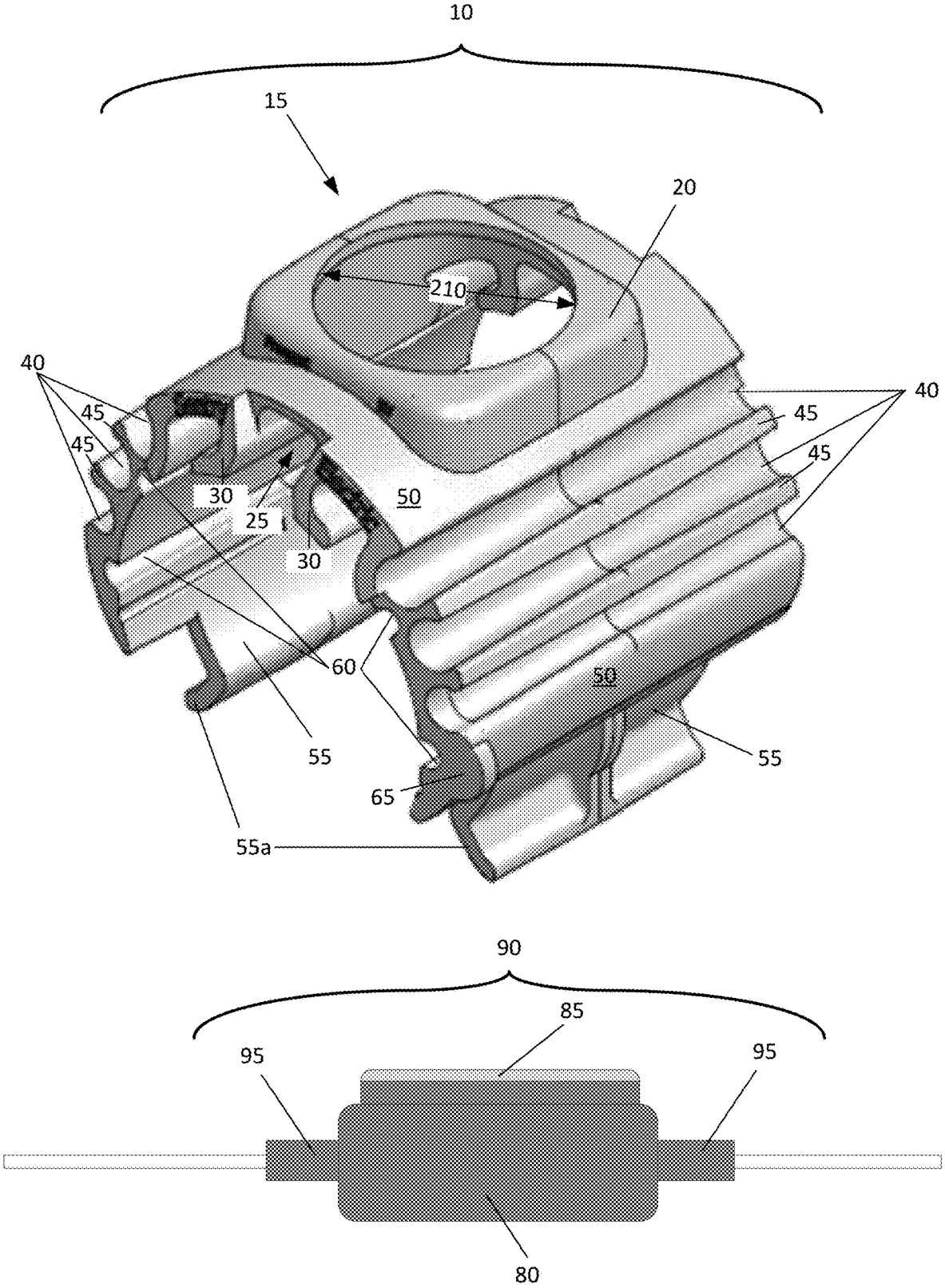
FIG. 2 is a top perspective view of a light clip and a side view of a light fixture.

FIG. 2 is a top perspective view of a light clip, arranged in accordance with at least some embodiments presented herein. Those components in FIG. 2 that are labeled identically to components of FIG. 1 will not be described again for the purposes of clarity.

Walls 20 may define opening 210. Opening 210 may be configured to accept face 85 of light fixture 90. Opening 210 may be configured to allow light from light fixture 90 to radiate out from light clip 10 while light fixture 90 is secured within light clip 10.

Figure 3:
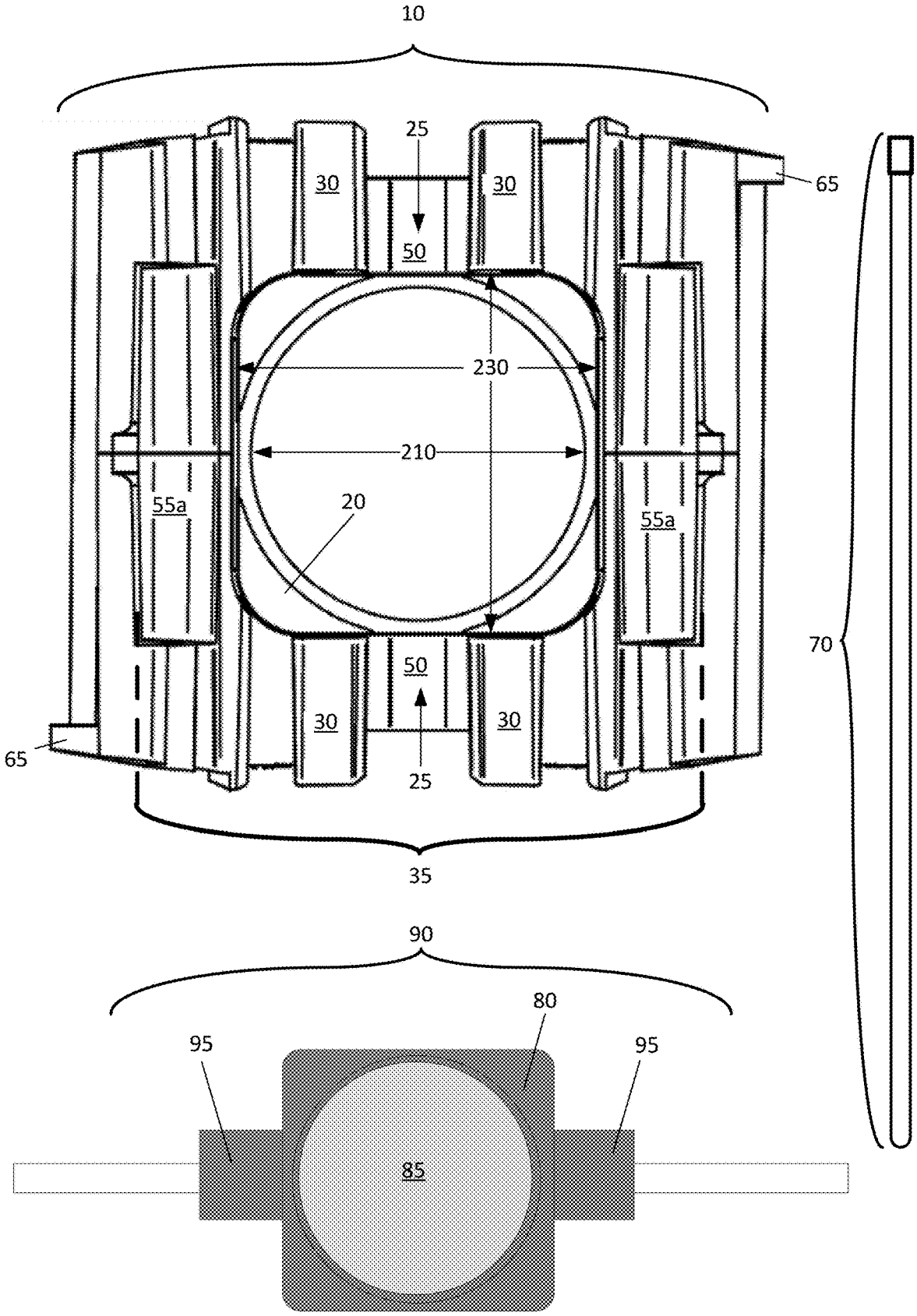
FIG. 3 is a bottom view of a light clip and a top view of a light fixture.

FIG. 3 is a bottom view of a light clip, arranged in accordance with at least some embodiments presented herein. Those components in FIG. 3 that are labeled identically to components of FIGS. 1-2 will not be described again for the purposes of clarity.

As shown in FIG. 3, light clip 10 may include multiple tabs 30. Two tabs 30 and wall 50 may define protrusion opening 25 on a first side of light clip 10 and two tabs 30 and wall 50 may define protrusion opening 25 on a second side of light clip 10. Openings 25 may be configured to accept protrusions 95 of light fixture 90.

Walls 20 may define opening 210. Opening 210 may be configured to accept face 85 of light fixture 90. Walls 20 along with walls 50 may further define opening 230. Opening 230 may be configured to accept body 80 of light fixture 90.

In an example, a light fixture 90 may be secured within light clip 10 by aligning face 85 of light fixture 90 with opening 210, aligning body 80 of light fixture 90 with opening 230, and securing protrusions 95 with tabs 30 by placing protrusions 95 within openings 25. Light fixture 90 may then be secured to a structure, such as a support beam, a support cable, or a protrusion of an edifice, by securing light clip to the structure. Open end 35 of light clip 10 may be pressed against the structure and open end 35 may expand further open so that light clip 10 may at least partially wrap around the structure and secured light fixture 90 to the structure. Light fixture 90 within light clip 10, may be positioned with respect to the structure to control a direction of light emitted from light fixture 90. One or more tie wraps 70 may be used to further secure light clip 10 and light fixture 90 to the structure. Tie wrap 70 may be placed and secured around light clip 10 and the structure when light clip 10 is secured to a structure. Tie wrap 70 may be positioned around light clip 10 so that tie wrap 70 is in contact with walls 50 and tabs 65, and tie wrap 70 encircles light clip 10 and the structure. Tabs 65 may be configured to prevent tie wrap 70 from sliding off of walls 50 of light clip 10 when tie wrap 70 is secured to light clip 10 and the structure. Tie wrap 70 may be secured and may further secure light clip 10 and light fixture 90 to the structure. Tie wrap 70 may be metal, including stainless steel, plastic, including nylon 6,6, or any other fastening material.

Figure 4:
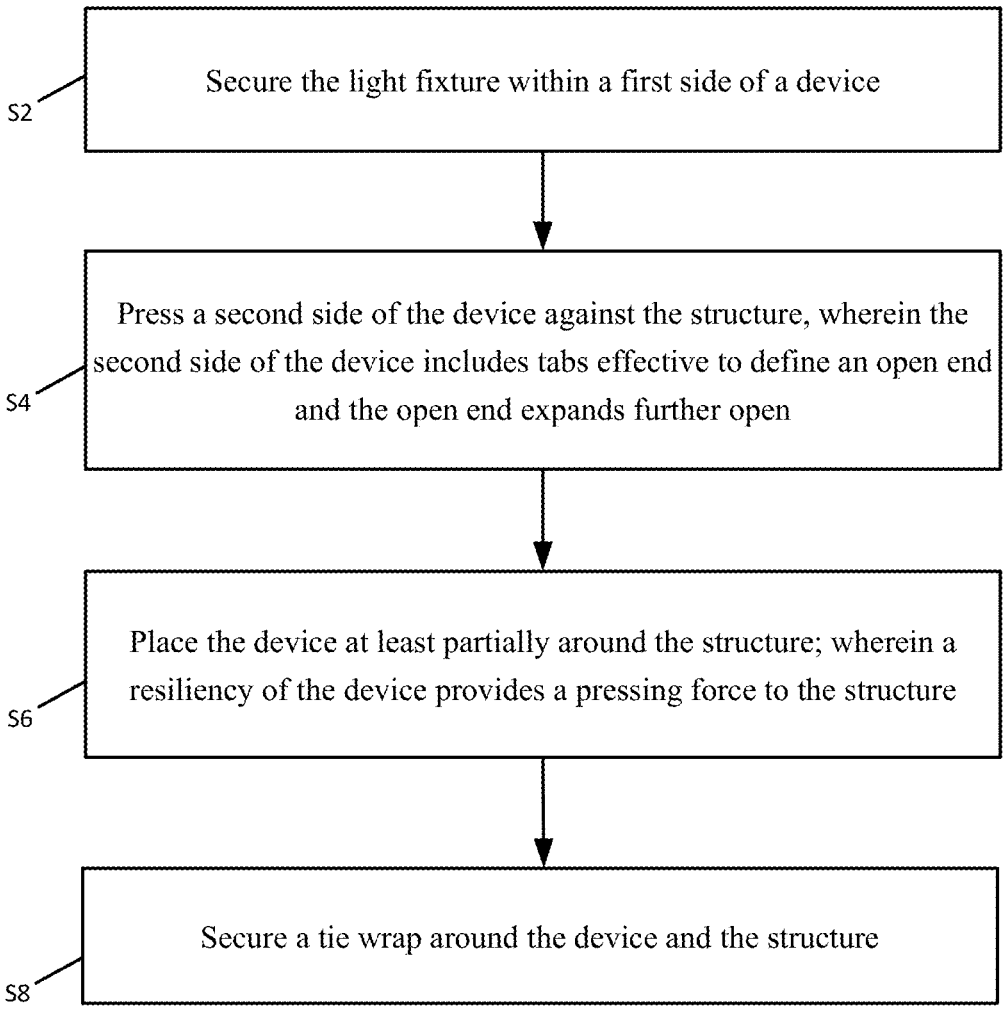
FIG. 4 illustrates a flow diagram of an example process to secure a light fixture to a structure.

FIG. 4 illustrates a flow diagram of an example process to secure a light fixture to a structure. The process in FIG. 4 could be implemented using, for example, device 10 discussed above. An example process may include one or more operations, actions, or functions as illustrated by one or more of blocks S2, S4, S6, S8, S10, S12, S14, S16, S18, and/or S20. Although illustrated as discrete blocks, various blocks may be divided into additional blocks, combined into fewer blocks, or eliminated, depending on the desired implementation.

Processing may begin at block S2, "Secure the light fixture within a first side of a device." At block S2, the light fixture may be secured within a device. The light fixture may include a face, protrusions, a light source, and electronics to drive the light source. The device may include a curved end of the device. The curved end may include first walls, second walls, first tabs, second tabs, and third tabs. The first walls may define a first opening. The first opening may be configured to accept the face of the light fixture. The first tabs may project from the second walls. The first tabs and the second walls may define a first protrusion opening on a first side of the device. The first tabs and the second walls may define a second protrusion opening on a second side of the device. The second walls and first tabs may be configured to accept and secure the light fixture when the protrusions of the light fixture are placed within the first and second protrusion openings. The first tabs may be resilient and may provide a pressing force to the protrusions when the protrusions are placed within the first and second protrusion openings. The pressing force provided by the first tabs may secure the protrusions in the first and second protrusion openings.

Processing may continue from block S2 to block S4, "Press a second side of the device against the structure, wherein the second side of the device includes tabs effective to define an open end and the open end expands further open." At block S4, a second side of the device may be pressed against the structure. The second end of the device may include end tabs and angled ends. The angled ends may extend at an angle from a plane of the end tabs. The end tabs and the angled ends may be effective to define a second opening. The angled ends may be configured such that the second opening of the device expands further open when the angled ends are pressed against the structure.

Processing may continue from block S4 to block S6, "Place the device at least partially around the structure; wherein a resiliency of the device provides a pressing force to the structure." At block S6, the device may be placed at least partially around the structure. A resiliency of the device may provide a pressing force to the structure. The pressing force provided by the device to the structure may secure the structure within the device. The pressing force provided by the device to the structure may allow the device to be positioned around the structure.

Processing may continue from block S6 to block S8, "Secure a tie wrap around the device and the structure." At block S8, a tie wrap may be secured around the device and the structure. The tie wrap may be positioned around the device so that the tie wrap is in contact with the second walls and the third tabs, and the tie wrap encircles the device and the structure. The third tabs may be configured to prevent the tie wrap from sliding off of the second walls of the device when the tie wrap is secured to the device and the structure. The tie wrap may be secured and may further secure the device and the light fixture to the structure. The tie wrap may be metal, including stainless steel, plastic, including nylon 6,6, or any other fastening material.

A device in accordance with the present disclosure may enable a user to secure a light fixture to a structure with a single hand. A user may be able to easily attach a tie wrap to more stably secure a light fixture to a structure as the light fixture will be clamped to the structure and not require the user to hold and position the light fixture while attaching a tie wrap.

A device in accordance with the present disclosure may enable a user to save manpower as a user would be able to secure a light fixture to a structure such as a bridge or building without assistance. Light clips may allow light fixtures to be secured to a structure faster than light fixtures without light clips. A device in accordance with the present disclosure may provide a safer work condition as light fixtures may be placed within light clips at a safer location prior to securing the light clip to a structure.

While various aspects and embodiments have been disclosed herein, other aspects and embodiments will be apparent to those skilled in the art. The various aspects and embodiments disclosed herein are for purposes of illustration and are not intended to be limiting, with the true scope and spirit being indicated by the following claims.

What is claimed is:

1. A device to secure a light fixture to a structure, wherein the light fixture includes a light source and electronics to drive the light source, the device comprising:

a first end of the device, wherein the first end of the device is curved and includes first walls and second walls, wherein the first walls define a first opening configured to accept a face of the light fixture so that light from the light fixture radiates out from the device when the light fixture is within the device;

first tabs, wherein the first tabs project from the second walls, the first tabs and the second walls define a first protrusion opening on a first side of the device, the first tabs and the second walls define a second protrusion opening on a second side of the device, and the second walls and first tabs are configured to accept and secure the light fixture when protrusions of the light fixture are placed within the first and second protrusion openings; and a second end of the device, wherein the second end of the device includes end tabs and angled ends, the end tabs are attached to the second walls and the angled ends extend from the end tabs, wherein the end tabs and the angled ends are effective to define a second opening and the angled ends are configured such that the second opening of the device expands further open when the angled ends are pressed against the structure to allow the device to be at least partially positioned around and secured to the structure.

2. The device of claim 1, wherein the device includes one or more of a plastic material, a metal, and/or a composite material.

3. The device of claim 1, wherein the device includes one or more of polyamide (PA), ethylene vinyl acetate (EVA), low-density polyethylene (LDPE), high-density polyethylene (HDPE), polypropylene (PP), polyvinyl chloride (PVC), thermoplastic elastomer (TPE), polyethylene terephthalate (PET), styrene acrylonitrile (SAN), acrylonitrile butadiene styrene (ABS), polycarbonate PC, copolymer, cellulosic, and/or cellulose acetate, with or without glass reinforcement.

4. The device of claim 1, further comprising second tabs, wherein the second tabs project from the second walls, and the second tabs and the second walls define channels.

5. The device of claim 4, wherein the channels are sized and shaped so as to accept and secure a wire or coaxial cable.

6. The device of claim 1, wherein the second walls define a channel and the channel is configured to accept and secure a filament of material with friction properties different from and greater than the device.

7. The device of claim 1, further comprising second tabs, wherein the second tabs project from the second walls the second tabs are configured to prevent a tie wrap from sliding off of the device.

8. The device of claim 1, wherein the angled ends extend from the end tabs at an angle from 45 to 135 degrees from the plane of the end tabs.

9. The device of claim 1, wherein the structure is a support beam, a support cable, a pole, or a protrusion of an edifice.

10. A system to secure a light fixture to a structure, the system comprising:

a light fixture, wherein the light fixture includes a face, protrusions, a light source, and electronics to drive the light source;

a tie wrap; and a device;

wherein the device includes:

a curved end of the device, where the curved end includes first walls, second walls, first tabs, second tabs, and third tabs, wherein:

the first walls define a first opening configured to accept the face of the light fixture;

the first tabs project from the second walls, the first tabs and the second walls define a first protrusion opening on a first side of the device and the first tabs and the second walls define a second protrusion opening on a second side of the device, wherein the second walls and first tabs are configured to accept and secure the light fixture when the protrusions of the light fixture are placed within the first and second protrusion openings;

the second tabs project from the second walls, and the second tabs and the second walls define first channels configured to accept and secure a wire or coaxial cable;

the third tabs project from the second walls, and the third tabs are configured to prevent the tie wrap from sliding off of the device; and a second end of the device, wherein the second end of the device includes end tabs and angled ends effective to define a second opening, and the angled ends are configure such that the second opening of the device expands further open when the angled ends are pressed against the structure to allow the device to be at least partially positioned around and secured to the structure.

11. The device of claim 10, wherein the device includes nylon 6,6.

12. The device of claim 10, wherein the angled ends extend from the end tabs at an angle from 45 to 135 degrees.

13. The device of claim 10, wherein the structure is a support beam, a support cable, or a protrusion of an edifice.

* * * * *